US006343588B1

(12) United States Patent
Onishi et al.

(10) Patent No.: US 6,343,588 B1
(45) Date of Patent: Feb. 5, 2002

(54) VARIABLE DELIVERY FUEL SUPPLY DEVICE

(75) Inventors: Yoshihiko Onishi; Masayasu Miyajima, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/613,716

(22) Filed: Jul. 11, 2000

(30) Foreign Application Priority Data

Mar. 1, 2000 (JP) ..... 2000-055335

(51) Int. Cl.[7] ..... F02M 37/04
(52) U.S. Cl. ..... 123/506; 123/458
(58) Field of Search ..... 123/458, 506, 123/449, 357, 500, 501

(56) References Cited

U.S. PATENT DOCUMENTS

| | | | | |
|---|---|---|---|---|
| 4,793,313 A | * | 12/1988 | Paganon et al. | 123/506 |
| 5,058,553 A | * | 10/1991 | Kondo et al. | 123/456 |
| 5,375,575 A | * | 12/1994 | Ohishi et al. | 123/446 |
| 6,053,712 A | * | 4/2000 | Konishi et al. | 123/506 |
| 6,102,010 A | * | 8/2000 | Isozumi et al. | 123/506 |
| 6,135,090 A1 | * | 1/2001 | Sakasai | 123/500 |
| 6,167,870 B1 | * | 1/2001 | Sakasai | 123/500 |
| 6,192,856 B1 | * | 2/2001 | Shioi et al. | 123/506 |

FOREIGN PATENT DOCUMENTS

| | | | |
|---|---|---|---|
| JP | 10-176625 | 6/1998 | F02M/59/10 |
| JP | 11-200990 | 7/1999 | F02M/59/36 |

* cited by examiner

*Primary Examiner*—Carl S. Miller
(74) *Attorney, Agent, or Firm*—Sughrue Mion, PLLC

(57) ABSTRACT

In a variable delivery fuel supply device providing a stable control of fuel pressure without being influenced by a scattering of control of an electromagnetic valve and without causing an increase of temperature in the coil of the electromagnetic valve, the variable delivery fuel supply device comprises fuel injection valves 1*a*–1*d* for injecting fuel to respective cylinders of an internal combustion engine, a fuel pump 3 which sucks fuel from a fuel intake passage 25 through an intake valve 26 into a pressurizing chamber 17 by a reciprocating movement of a plunger 15 in a cylinder 14 and discharges the pressurized fuel into the delivery pipe through a discharge valve 27, an electromagnetic valve 28 which is located in a relief passage 31 communicating the pressurizing chamber 17 of the fuel pump 3 with the fuel intake passage 25 and is adapted to control a discharge quantity of fuel by relieving the pressurized fuel in the pressurizing chamber 17 at the time of opening the valve, and a control unit 13 for supplying a valve-opening signal to the electromagnetic valve 28, wherein the supply of the valve-opening signal from the control unit 13 to the electromagnetic valve 28 is stopped when the plunger 15 reaches a predetermined position which passes through a top dead point, in an intake stroke of the plunger from a top dead point to a bottom dead point.

3 Claims, 4 Drawing Sheets

VARIABLE DELIVERY FUEL SUPPLY DEVICE

BACKGROUND OF THE INVENTION

1. Field of the Invention

The present invention relates to a variable delivery fuel supply device which is used for an internal combustion engine for automobiles, in particular, for a cylinder injection type gasoline engine requiring highly pressurized fuel and which is capable of controlling an amount of fuel to be supplied to fuel injection valves.

2. Discussion of Background

The variable delivery fuel supply device used for an internal combustion engine for automobiles comprises a plurality of fuel injection valves for injecting fuel to the respective cylinders of the internal combustion engine, a delivery pipe for supplying fuel to the fuel injection valves, a fuel pump for supplying pressurized fuel to the delivery pipe, a low pressure fuel pump for supplying fuel from a fuel tank to the fuel pump, and control means for controlling an injection timing of fuel; a quantity of fuel to be discharged and a discharge quantity of fuel from the fuel pump.

The fuel pump comprises a cylinder, a plunger which performs a reciprocating movement in the cylinder to suck fuel into a pressurizing chamber in a suction stroke and which supplies forcibly fuel in the pressurizing chamber to the delivery pipe in a discharge stroke, the plunger being driven by a driving cam attached to a cam shaft of the internal combustion engine, and an electromagnetic valve which controls a discharge quantity of the fuel from the pressurizing chamber by relieving fuel pressurized in the pressurizing chamber to a low pressure side at a predetermined timing to thereby control a fuel pressure in the delivery pipe to be a predetermined pressure level.

As the electromagnetic valve disclosed in, for example, JP-A-11-200990, a normally closed electromagnetic valve wherein a valve unit is closed when no control signal is supplied to the electromagnetic valve, is generally used. When a valve-opening signal is supplied from the control means, the electromagnetic valve is opened whereby pressurized fuel in the pressurizing chamber is relieved to a low pressure side. The control means is so adapted as to detect a fuel pressure in the delivery pipe and to supply a valve-opening signal to the electromagnetic valve depending on variations of fuel pressure to open the electromagnetic valve. In this case, the fuel pressure of the delivery pipe 2 increases when the fuel pump 3 performs a discharge stroke. Accordingly, the valve-opening signal is supplied in the way of the discharge stroke, and the width of the signal is determined so that the electromagnetic valve is closed at the moment of the completion of the discharge stroke.

FIG. 4 is a diagram for explaining a working stroke of a fuel pump and an operation timing of an electromagnetic valve in the conventional variable delivery fuel supply device, which is described in, for example, JP-A-11-200990. The piston lift quantity in FIG. 4 corresponds to a movement of a plunger performing a reciprocating movement due to the driving action of a driving cam of an internal combustion engine wherein the stroke from a bottom dead point to a top dead point is a pressurizing stroke, and an amount of fuel corresponding to a movement of the plunger in a pressurizing stroke is forcibly supplied from the pressurizing chamber to the delivery pipe. The stroke from the top dead point to the bottom dead point is a suction stroke during which fuel is fed from the fuel tank to the pressurized chamber.

In FIG. 4, strokes A to D respectively represent a characteristic movement in one cycle of the plunger in the fuel pump.

The stroke of the plunger in the conventional fuel pump and the movement of the conventional electromagnetic valve will be explained with reference to FIG. 4.

The stroke A shows a case that a discharge quantity of fuel from the fuel pump is 50% with respect to a discharge quantity in the whole stroke. Namely, a valve-opening signal is supplied to the electromagnetic valve to open it at a 50% position in a one cycle stroke of the plunger in a discharge stroke, and the valve-opening signal is stopped at the top dead point of the plunger, i.e., at the moment of the completion of the discharge stroke, whereby the electromagnetic valve is closed.

The stroke B shows a case that the valve-opening signal is supplied when a discharge quantity is 75%. The valve-opening signal is stopped with the completion of the discharge stroke in the same manner as in the stroke A.

The stroke C shows an operating condition of the fuel pump in such a case that the fuel pump discharges a large quantity of fuel, but a fuel consumption rate is low. For example, the internal combustion engine is operated at a high revolution but an applied load is light, e.g., an engine brake is used. In such case, a fuel pressure in the delivery pipe is maintained at a predetermined value. A discharge quantity of fuel by the fuel pump is 0% and a relief quantity by the electromagnetic valve is 100%. This means that the valve-opening signal is supplied over the entire period of one stroke of the plunger.

The stroke D shows a case that a discharge quantity of fuel by the fuel pump is small, but a fuel consumption rate is high. For example, the internal combustion engine is operated at a low revolution but under a heavy load, In such case, no valve-opening signal is supplied so that a discharge quantity is made 100%.

Among these strokes, a state of the discharge quantity being 0% or 100% does not frequently occur. Under the condition of normal use, the valve-opening signal is supplied in the way of the pressurizing stroke of the plunger and is stopped when the plunger reaches a top dead point as described before. Since the width of the valve-opening signal is determined dependent on a fuel pressure in the delivery pipe, it also varies depending on a revolution number of the internal combustion engine and a load applicable to the engine. Further, it varies in each stroke of the plunger even when the revolution number and the load are constant. Accordingly, the control means supplies a valve-opening signal by calculating a valve-opening timing and a width of the valve-opening signal for each stroke.

However, in the conventional variable delivery fuel supply device for supplying a valve-opening signal to the electromagnetic valve as described above, there was a problem as follows. The time at which a fuel pressure in the delivery pipe reached a predetermined value was sometimes just before the time point that the plunger passed a top dead point in a case that, for example, the fuel pressure in the delivery pipe was near the predetermined value or a fuel consumption rate was relatively high with respect to a discharge quantity of fuel by the fuel pump, which may occur immediately after the starting of the engine. Since a time between the time that the fuel pressure reached a predetermined value and the time that the plunger passed the top dead point was very short, a valve-opening signal was supplied as a pulse signal having a small width. On the other hand, there was anther problem as follows. Since there was a certain delay in the response characteristic of the electromagnetic valve when it received a valve-opening signal, the electromagnetic valve could not follow a pulse signal of small width, whereby control became inoperable and a fuel pressure in the delivery pipe became an unstable condition. In particular, when the internal combustion engine was operated at a high speed, a time of stroke of the plunger was short, and the width of the valve-opening signal was also small. Accordingly, the response characteristics of the electromagnetic valve was insufficient to increase the revolution speed of the engine to the maximum.

Further, there was another problem that since a control unit had also a scattering of control, the electromagnetic valve sometimes closed during the discharge stroke before the plunger reached the top dead point. In such case, the fuel pump might discharge twice whereby a fuel pressure in the delivery pipe increased beyond a predetermined value. Further, when the engine was operated at high revolution speed but with a low load, e.g., under the condition that an engine brake was used, there was a case that a fuel consumption rate was low in comparison with a discharge quantity of the fuel pump, and a condition that a discharge quantity was 0% continued. In such case, a rate of a current fed to the coil of the electromagnetic valve reaches 100%. Since the coil resistance is determined to be small in order to improve the response characteristics of the electromagnetic valve, there causes the problem of an abnormal rise of coil temperature. In order to suppress the temperature rise, the coil resistance of the electromagnetic valve should be increased. However, this invited a further deterioration of the response characteristics of the valve.

SUMMARY OF THE INVENTION

It is an object of the present invention to provide a variable delivery fuel supply device providing a stable control of fuel pressure without suffering the influence of the response characteristics of the electromagnetic valve and a scattering of control and without causing an abnormal increase of coil temperature.

In accordance with the present invention, there is provided a variable delivery fuel supply device which comprises fuel injection valves for injecting fuel to respective cylinders of an internal combustion engine, a delivery pipe for supplying pressurized fuel into the fuel injection valves, a fuel pump which sucks fuel from a fuel intake passage through an intake valve into a pressurizing chamber by a reciprocating movement of a plunger in a cylinder and discharges the pressurized fuel into the delivery pipe through a discharge valve, an electromagnetic valve which is located in a relief passage communicating the pressurizing chamber of the fuel pump with the fuel intake passage and is adapted to control a discharge quantity of the pressurized fuel by relieving the pressurized fuel in the pressurizing chamber into the fuel intake passage at the time of opening the valve, and control means for supplying a valve-opening signal to the electromagnetic valve, wherein the supply of,the valve-opening signal from the control means to the electromagnetic valve is stopped when the plunger reaches a predetermined position which passes through a top dead point, in an intake stroke of the plunger from a top dead point to a bottom dead point.

In the present invention, the supply of the valve-opening signal is stopped at the time when at least a response time of the electromagnetic valve has lapsed after the plunger has passed through the top dead point.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
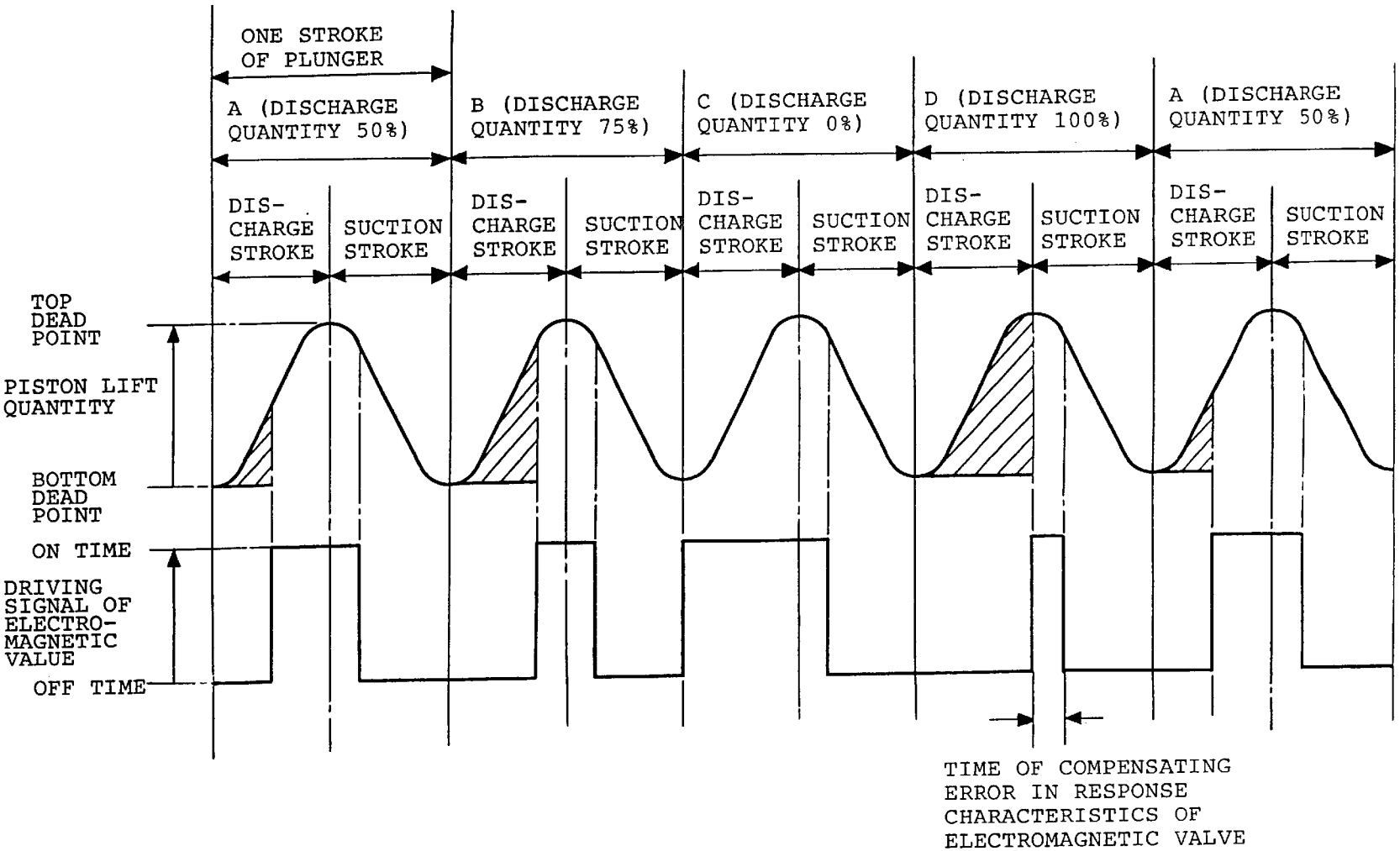
FIG. 1 is a diagram for explaining operations of the variable delivery fuel supply device according to Embodiment 1 of the present invention.

The variable delivery fuel supply device according to Embodiment 1 of the present invention will be described with reference to FIGS. 1 to 3 wherein the same reference numerals designate the same or corresponding parts.

Embodiment 1

Figure 2:
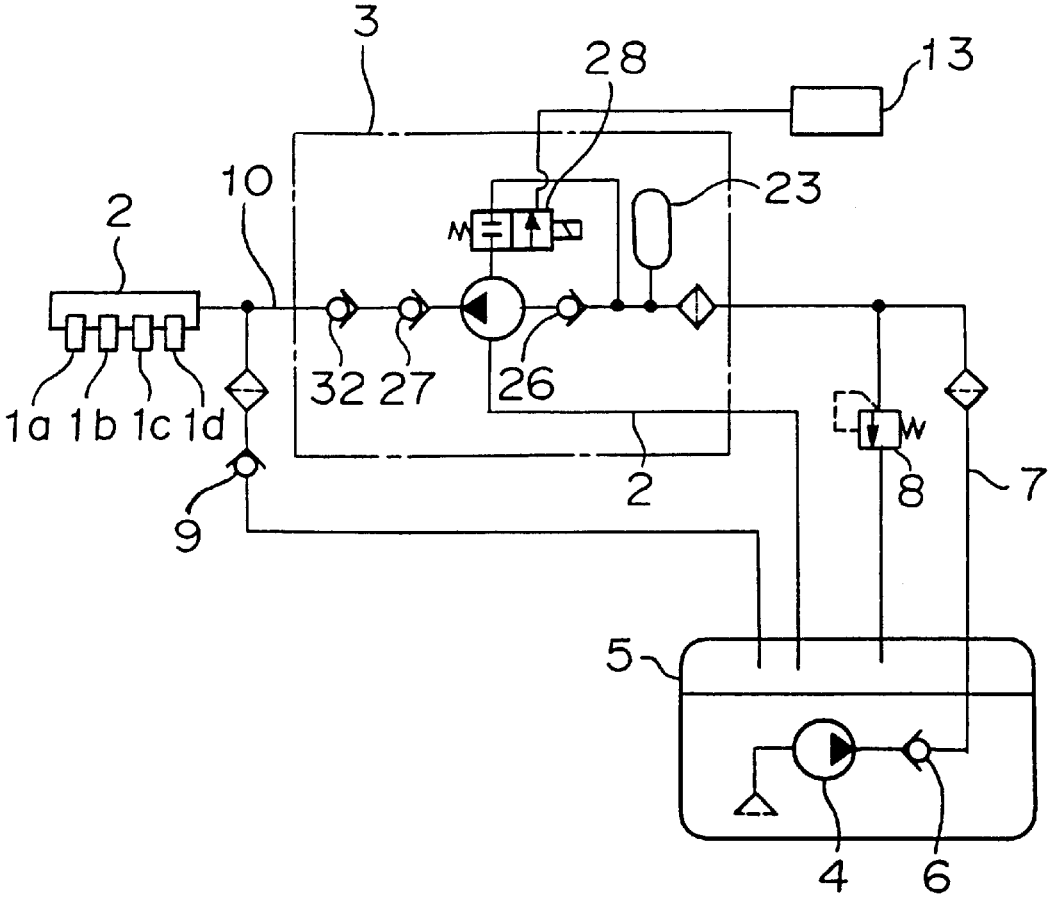
FIG. 2 is a systematic diagram showing the construction of the variable delivery fuel supply device of the embodiment of the present invention.

In FIG. 2, reference numerals 1*a* through 1*d* designate fuel injection valves for injecting fuel to the respective cylinders in an internal combustion engine, numeral 2 designates a delivery pipe which stores pressurized fuel and supplies it to the fuel injection valves 1*a*–1*d,* numeral 3 a fuel pump for supplying pressurized fuel to the delivery pipe 2 through a fuel passage 10, numeral 4 a low pressure fuel pump for supplying fuel from a fuel tank 5 through a fuel passage 7 to the fuel pump 3, numeral 6 a check valve provided in the fuel passage 7 to maintain a fuel pressure in the fuel passage 7 for a predetermined time when the engine is stopped, numeral 8 a low pressure regulator for controlling a pressure in the fuel passage 7, numeral 9 a check valve to relieve fuel to the fuel tank 5 via the fuel passage 10 and a fuel passage 11 when a fuel pressure in the delivery pipe 2 exceeds a predetermined value, numeral 12 a return passage to return fuel from the fuel pump 3 to the fuel tank 5 and numeral 13 control means to control a fuel pressure.

Figure 3:
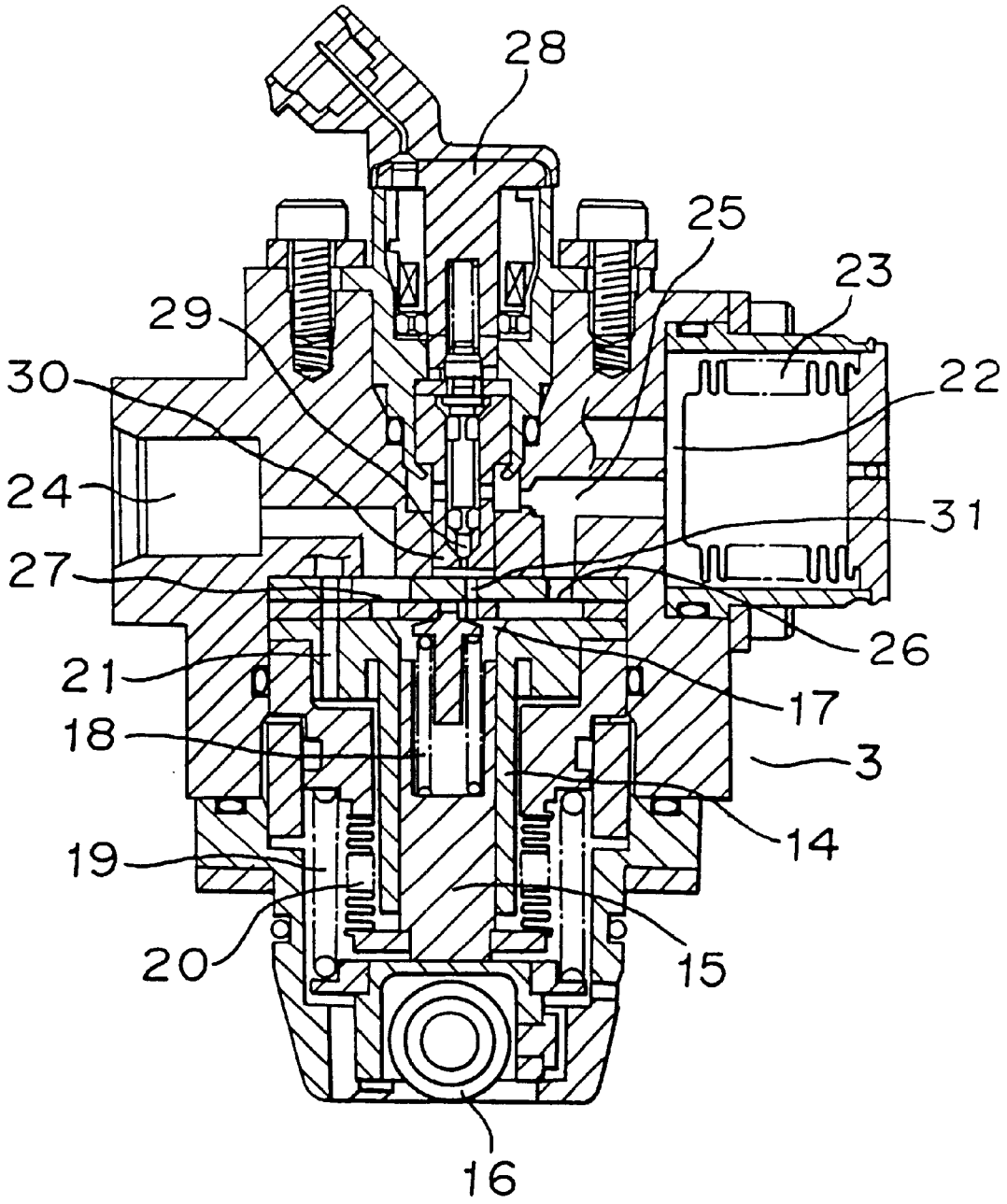
FIG. 3 is a cross-sectional view of a fuel pump used for the variable delivery fuel supply device of the embodiment of the present invention.

In the fuel pump 3 shown in FIG. 3, reference numeral 14 designates a cylinder, numeral 15 a plunger which performs a reciprocating movement in the cylinder 14 to suck fuel into a pressurizing chamber 17 in which the sucked fuel is pressurized, wherein the plunger is driven by a driving cam of the internal combustion engine (although they are not shown in FIG. 3) by means of a roller 16, numeral 18 a spring for urging always the plunger 15 in a direction of expanding the pressurizing chamber 17, numeral 19 a spring for urging the roller 16 toward a side of the cam shaft (not shown), and numeral 20 a bellows made of metal which is for sealing fuel possibly leaking from a gap between the cylinder 14 and the plunger 15. The fuel leaking into the metallic bellows 20 is returned to the fuel tank 5 through a return passage 21 and the return passage 12 shown in FIG. 2. Numeral 22 designates a fuel intake port having a low pressure damper 23 and numeral 24 designates a fuel discharge port connected to the delivery pipe 2 by means of the fuel passage 10 (FIG. 2). The fuel intake port 22 is communicated with the pressurizing chamber 17 through a fuel intake passage 25 and an intake valve 26 which comprises a check valve such as a reed valve, and the fuel discharge port 24 is communicated with the pressurizing chamber 17 through a discharge valve 27.

Reference numeral 28 designates an electromagnetic valve which is normally closed, but is opened when a valve-opening signal is given to it from the control means 13. The electromagnetic valve 28 is provided with a valve unit comprising a valve 29 and a valve seat 30, which is so adapted to open and close a relief passage 31 communicated with the pressurizing chamber 17 and the fuel intake passage 25. When the electromagnetic valve 28 is opened, fuel pressurized in the pressurizing chamber 17 flows through the relief passage 31 to the fuel intake passage 25. The fuel pump 3 is mounted on the internal combustion engine and is driven by a cam for driving the pump, which is provided on a cam shaft in the internal combustion engine so as to pressurize fuel with the rotation of the engine and to supply forcibly the fuel to the delivery pipe 2. The control means 13 receives data of a revolution speed of the engine, a rotation angle of the cam shaft, a fuel pressure in the delivery pipe 2 and so on from sensors (not shown) and gives a valve-opening signal to the electromagnetic valve 28.

In the variable delivery fuel supply device according to the embodiment of the present invention, when a key switch in the internal combustion engine is turned on, the low pressure fuel pump 4 of motor-driven type is actuated whereby fuel is supplied from the fuel tank 5 to the fuel pump 3. As soon as the internal combustion engine is operated, the fuel pump 3 is driven so that the discharge valve 27 is closed and the intake valve 26 is opened in a suction stroke of the plunger 15, whereby fuel is sucked into the pressurizing chamber 17 through the fuel intake port 22 and the fuel passage 25, and in a discharge stroke of the plunger 15, the intake valve 26 is closed and the discharge valve 27 is opened with the result that pressurized fuel is supplied forcibly to the delivery pipe 2 via the fuel discharge port 24 and the fuel passage 10. When the engine is stopped, the fuel pressure in the fuel pump 3 will decrease. However, the fuel pressure in the delivery pipe 2 can be maintained for a predetermined time by closing a fuel pressure maintaining valve 32.

The reciprocating movement of the plunger 15 becomes fast with an increase of the rotation speed of the internal combustion engine. When a fuel pressure in the delivery pipe 2 reaches a predetermined value, the control means detects the fact and supplies a valve-opening signal to the electromagnetic valve 28. Then, the electromagnetic valve 28 is opened to communicate the pressurizing chamber 17, in which highly pressurized fuel is stored, with the fuel intake passage 25 at a low fuel pressure side, with the result that the supply of the pressurized fuel from the pressurizing chamber 17 to the delivery pipe 2 is stopped, and a fuel pressure in the delivery pipe 2 is maintained to a predetermined value.

A series of control operations by the control means 13 is conducted as follows.

FIG. 1 shows an example of the control operations. As shown in FIG. 1, the timing of applying the valve-opening signal by the control means 13 is determined depending on a value of fuel pressure detected in the delivery pipe 2. On the other hand, the position at which the supply of the valve-opening signal is stopped should be after the plunger 15 has passed through a top dead point. Each of strokes A–D in FIG. 1 represents a characteristic movement of the plunger.

The stroke A shows a case that a fuel pressure in the delivery pipe 2 has reached a predetermined value by discharging fuel in an amount corresponding to 50% with respect to the whole stroke of the plunger 15. Namely, a valve-opening signal is supplied to the electromagnetic valve 28 to open it at a 50% position in a stroke of the plunger 15 from a bottom dead point to the top dead point subsequent thereto, and the supply of the valve-opening signal is continued until the plunger has passed through the top dead point and has reached a predetermined position. Since the period of discharge of fuel by the plunger is a time from the bottom dead point to the top dead point, the quantity of fuel relieved is 50% of the whole stroke in this case.

The stroke B shows a case that a fuel pressure in the delivery pipe 2 has reached a predetermined value by discharging fuel in an amount corresponding to 75% with respect to the whole stroke of the plunger 15. In this case, a valve-opening signal is supplied to the electromagnetic valve 28 to open it at a 75% position in a stroke of the plunger 15 from a bottom dead point to a top dead point subsequent thereto. The supply of the valve-opening signal is continued until the plunger has passed through the top dead point and has reached a predetermined position in the same manner as in the case of the stroke A.

The stroke C shows a case that a fuel pressure in the delivery pipe 2 satisfies a predetermined value, and therefore, a judgment is made so that a fuel quantity to be discharged is zero. In this case, the valve-opening signal is supplied at a bottom dead point of the plunger 15 and the valve-opening signal is continued until the plunger has passed through the top dead point and has reached a predetermined position in the same manner as in the cases of the stroke A and the stroke B.

The stroke D shows a case that a fuel pressure in the delivery pipe 2 is low and an amount of 100% discharge is needed as in a case that a much amount of fuel is consumed. In this case, there is no need of relieving fuel for pressure control and a valve-opening signal is supplied to the electromagnetic valve 28 at the top dead point of the plunger 15 or a point after the dead point in considering error in the response characteristics of the plunger 15. The valve-opening signal is supplied until the plunger has passed through the top dead point and has reached a predetermined position in the same manner as in the cases of the stroke A to the stroke C. The time at which the valve-opening signal is stopped, i.e., the predetermined position after the plunger has passed through a top dead point is determined based on a predetermined percentage with respect to a stroke of the plunger from a top dead point to a bottom dead point. Or, it is determined in a time sufficient to compensate error in the response characteristics of the electromagnetic valve 28 and a scattering of control of the control unit 13, as shown in the stroke D in FIG. 1.

Figure 4:
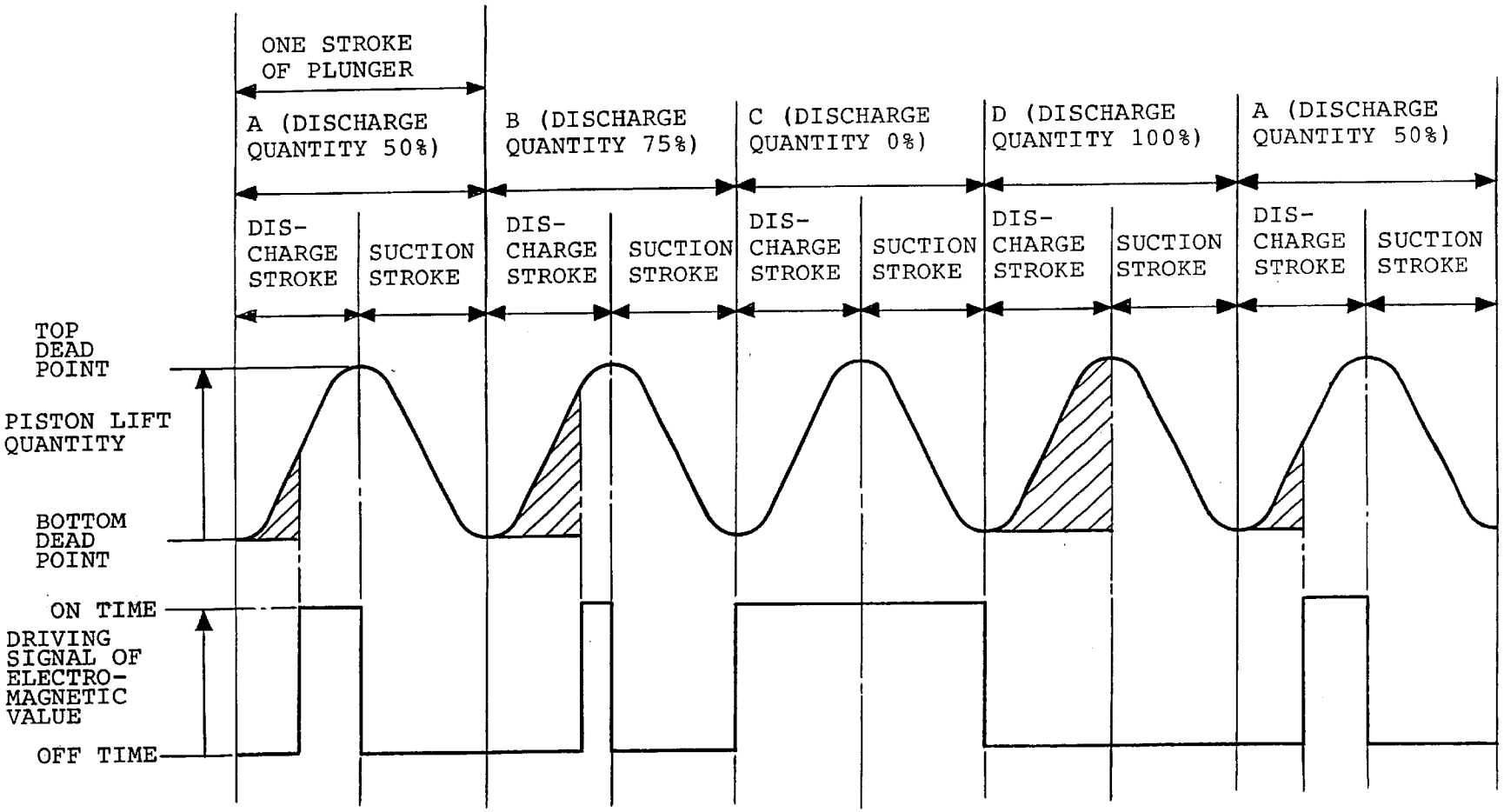
FIG. 4 PRIOR ART
FIG. 4 is a systematic diagram showing the construction of a conventional variable delivery fuel supply device.

By determining the controlling operations as described above, the valve-opening signal is determined to have a pulse width needed for the response characteristics of the electromagnetic valve 28. Further, since the electromagnetic valve is closed after the plunger 15 has passed through a top dead point, a stable control of discharge quantity of fuel is obtainable over the entire region of rotating speed of the internal combustion engine even though there is the scattering of control. Further, use of an electromagnetic valve having poor response characteristics is permissible. In addition, the control in a higher region of rotating speed of the internal combustion engine, which was conventionally difficult because of a limit in the response characteristics of the electromagnetic valve, can be conducted. Further, since there is no current feeding of 100% to the coil of the electromagnetic valve 28 unlike the conventional electromagnetic valve (FIG. 4), a temperature rise can be suppressed and the response characteristics of the electromagnetic valve can be improved.

As described above, according to the variable delivery fuel supply device of the present invention, the valve-opening time to the electromagnetic valve is continued until the plunger of the fuel pump has passed through the top dead point and has reached a predetermined position. Further, the predetermined position is determined in consideration of error in the response characteristics of the electromagnetic valve and a scattering of control. Accordingly, a stable control of fuel pressure is obtainable; a temperature rise in the coil of the electromagnetic valve can be suppressed to thereby provide a flexible design; the internal combustion engine can be operated at a high speed because control in a high rotational speed region is possible; and it is unnecessary to be so careful with increasing the precision of control of the control unit or the response characteristics of the electromagnetic valve.

Obviously, numerous modifications and variations of the present invention are possible in light of the above teachings. It is therefore to be understood that within the scope of the appended claims, the invention may be practiced otherwise than as specifically described herein.

The entire disclosure of Japanese Patent Application JP2000-055335 filed on Mar. 1, 2000 including specification, claims, drawings and summary are incorporated herein by reference in its entirety.

What is claimed is:

1. A variable delivery fuel supply device which comprises:

fuel injection valves for injecting fuel to respective cylinders of an internal combustion engine, a delivery pipe for supplying pressurized fuel into the fuel injection valves, a fuel pump which sucks fuel from a fuel intake passage through an intake valve into a pressurizing chamber by a reciprocating movement of a plunger in a cylinder and discharges the pressurized fuel into the delivery pipe through a discharge valve, an electromagnetic valve which is located in a relief passage communicating the pressurizing chamber of the fuel pump with the fuel intake passage and is adapted to control a discharge quantity of the pressurized fuel by relieving the pressurized fuel in the pressurizing chamber into the fuel intake passage at the time of opening the valve, and control means for supplying a valve-opening signal to the electromagnetic valve, wherein the supply of the valve-opening signal from the control means to the electromagnetic valve is stopped when the plunger reaches a predetermined position between a top dead point and a bottom dead point during an intake stroke of the plunger.

2. The variable delivery fuel supply device according to claim 1, wherein the supply of the valve-opening signal is stopped at the time when at least a response time of the electromagnetic valve has lapsed after the plunger has reached the top dead point.

3. The variable delivery fuel supply device according to claim 1, wherein the predetermined position is determined in consideration of error in the response characteristics of the electromagnetic valve and a scattering of control of the control means.

* * * * *